US005517927A

United States Patent [19]

Karpisek

[11] Patent Number: 5,517,927

[45] Date of Patent: May 21, 1996

[54] CONTAINER KIT

[76] Inventor: Ladislav S. Karpisek, 86 Woodfield Boulevarde, Caringbah, N.S.W. 2229, Australia

[21] Appl. No.: 335,842

[22] PCT Filed: May 24, 1993

[86] PCT No.: PCT/AU93/00234

§ 371 Date: Nov. 3, 1994

§ 102(e) Date: Nov. 3, 1994

[87] PCT Pub. No.: WO93/24379

PCT Pub. Date: Dec. 9, 1993

[30] Foreign Application Priority Data

May 25, 1992 [AU] Australia ..... PL2608

[51] Int. Cl.[6] ..... B65D 19/44

[52] U.S. Cl. ..... 108/55.1; 108/56.1

[58] Field of Search ..... 108/51.1, 55.1, 108/55.3, 55.5, 56.1

[56] References Cited

U.S. PATENT DOCUMENTS

| | | | |
|---|---|---|---|
| 2,754,077 | 7/1956 | Weber | 108/55.1 X |
| 3,648,877 | 3/1972 | Heft | 108/56.1 X |
| 3,770,186 | 11/1973 | Kupersmit | 108/55.1 X |
| 3,982,638 | 9/1976 | Lamson | 108/55.1 X |
| 5,388,532 | 2/1995 | Wakano | 108/55.1 |

FOREIGN PATENT DOCUMENTS

| | | | |
|---|---|---|---|
| 223944 | 3/1958 | Australia . | |
| 259617 | 5/1963 | Australia . | |
| 1528566 | 6/1969 | Australia . | |
| 2781284 | 11/1984 | Australia . | |
| 1443488 | 10/1988 | Australia . | |
| 5241890 | 10/1990 | Australia . | |
| 1439146 | 4/1966 | France | 108/55.1 |
| 2552044 | 5/1977 | Germany | 108/55.1 |
| 319429 | 12/1970 | Sweden | 108/55.1 |
| 868455 | 5/1961 | United Kingdom | 108/55.1 |
| WO8810223 | 12/1988 | WIPO . | |

*Primary Examiner*—José V. Chen
*Attorney, Agent, or Firm*—Edwin D. Schindler

[57] ABSTRACT

A container kit including a rectangular base ring with mounting structure on opposite sides of a base ring for engaging battens on opposite sides of a pallet. There is a first pair of rectangular side panels, each with a bottom adapted to engage in channels between upper base ring flanges and lower base ring flanges, and a second pair of like panels, each with a bottom adapted for engaging between upper base ring flanges and lower base ring flanges. The second panel pair is disposed between the first panel pair, thereby preventing the disconnection of all panels from channels between the upper and lower base ring flanges, with latches for connecting adjacent sides of the panels of the first and second panels.

6 Claims, 4 Drawing Sheets

Figure 1:
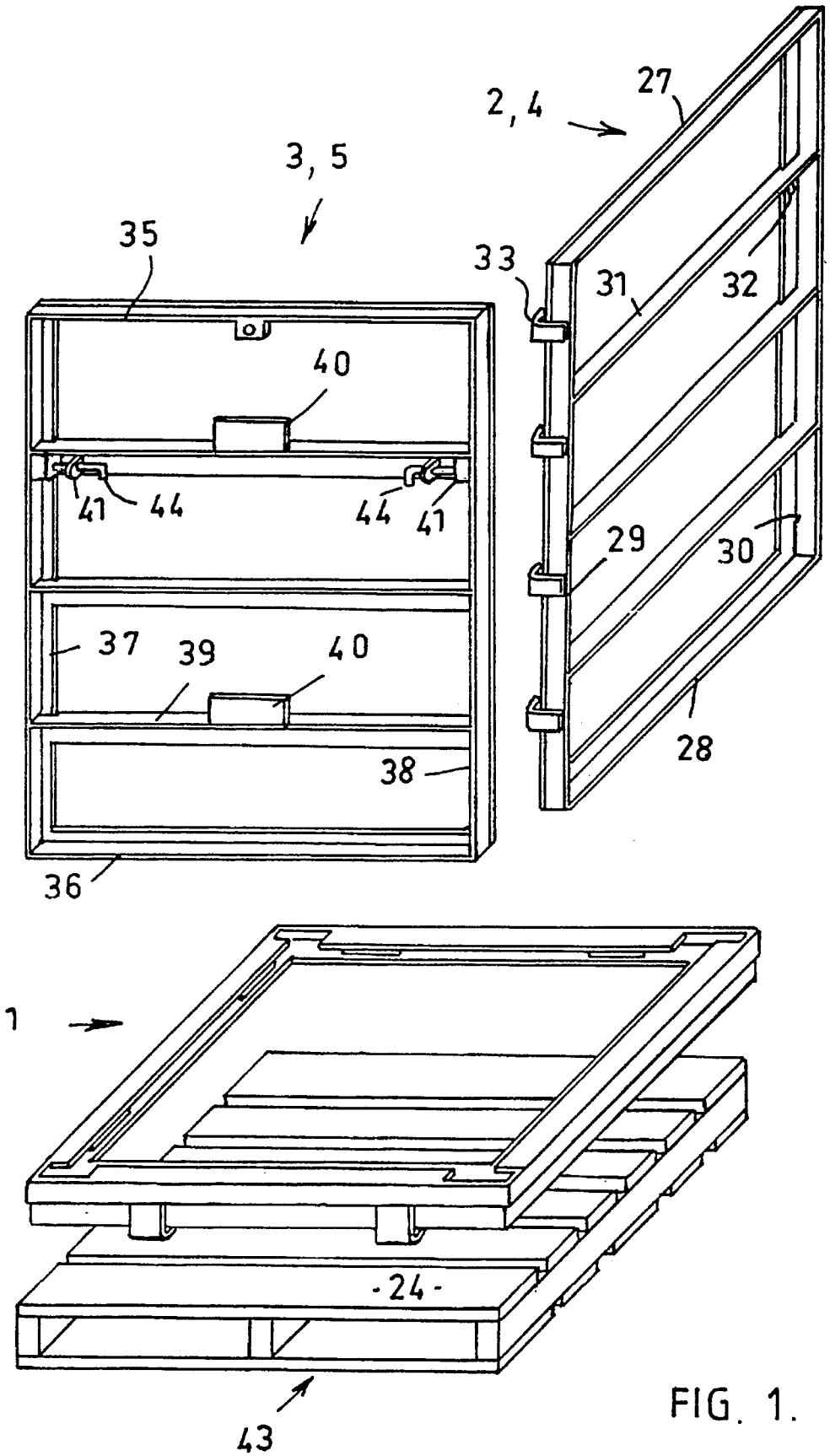

FIG. 2.
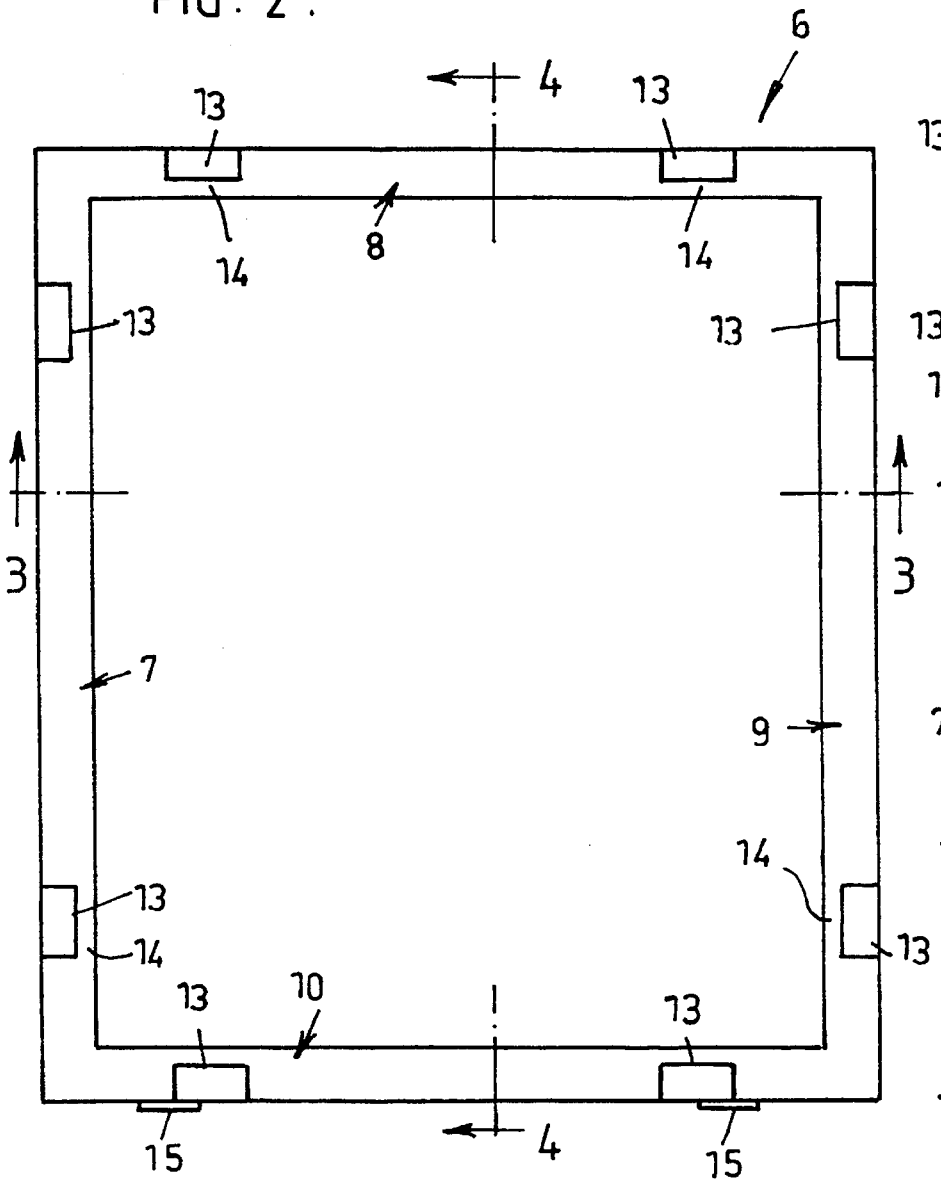
FIG. 3.
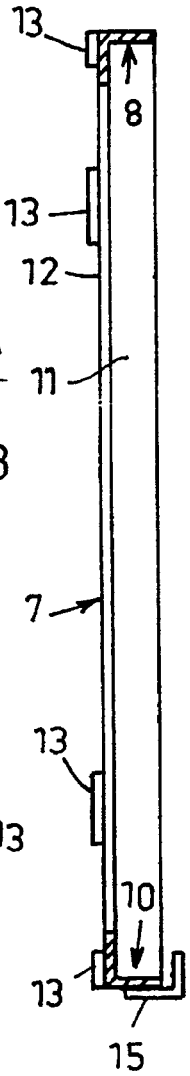
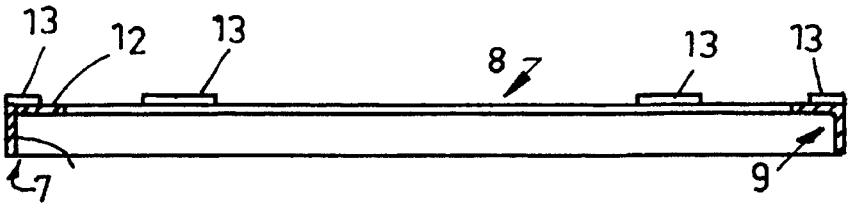
FIG. 4.

FIG. 8.
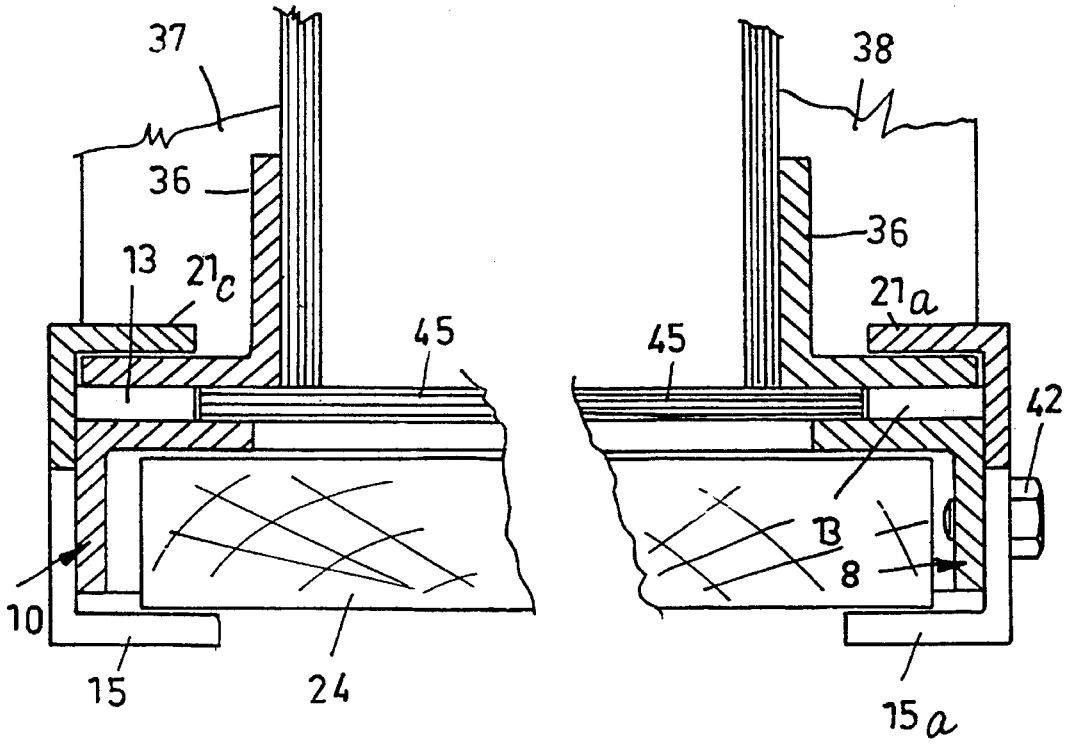
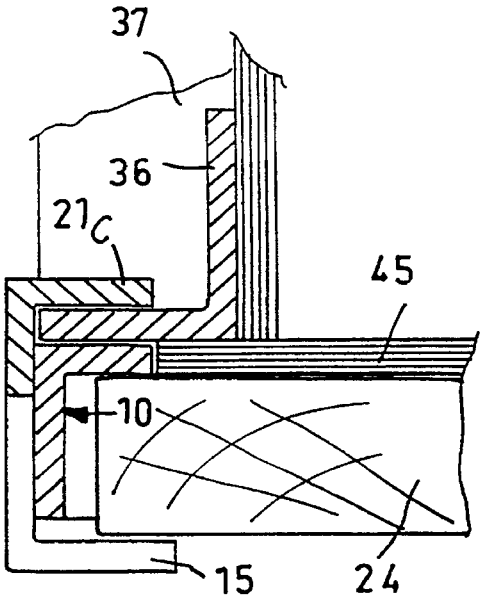
FIG. 9.

CONTAINER KIT

This invention relates to goods containers of the knock down type comprised of sides adapted for mounting on a pallet directly or through a base. Such containers may, and usually do, include a lid.

In the past there have been many attempts to provide a container of the above type, one such is disclosed in the patent application number 81490/91 by the same applicant. However, there is always the need for a container which performs substantially as well as those which have gone before but is of a more economical design. This invention has taken the art of design for such containers a step further and provides a simple, robust, economical design which can withstand the rigours of transporting difficult products, such as liquids, which produce high stresses on the container under dynamic conditions. In addition the present invention provides a container design which minimises the problem of 'bag pinch' which can now occur with some presently known containers.

Bag pinch occurs where under dynamic loads the container flexes in a way which provides gaps into which the plastic film liner bag of the container is forced by its liquid contents. When there is a reversal or reduction in the forces acting on the container the gaps close and the bag portions in the gaps can be damaged by pinching. Where pinching occurs the liner bag is most often weakened to the point where the likelihood of rupture becomes a possibility or, as can occur under some conditions, the pinching results in an immediate rupture of the liner bag.

Broadly stated, one form of the invention provides a container kit comprising a rectangular base ring which includes a pair of flanges inwardly directed from each side of the base ring thereby forming a horizontally inwardly directed mounting channel with an upper flange and a lower flange, mounting means on two opposite sides of the base ring including lugs extending inwardly to engage under the distal edges of battens on opposite sides of a pallet thereby to mount the base ring on a pallet, a first pair of rectangular side panels each having a top, two sides and a bottom with an out-turned lug means of thickness allowing entry into the mounting channel, a second pair of rectangular side panels each having a top, two sides and a bottom with an out-turned lug means of thickness allowing entry into the mounting channel, the width of the panels of the second panel pair between the sides thereof is less than the width of the panels of the first panel pair and the panels of the second panel pair are disposed between the first panel pair and prevent bodily movement of the panels of the first panel pair to disengage the lugs means thereof from the engaged base ring channels, and latching means to connect adjacent sides of the first and second panel pairs.

In another form the invention provides a container kit comprising a rectangular base ring which includes a first flange inwardly directed from each side of the base ring, a second flange inwardly directed from each side of the base ring narrower than the first flange and spaced from and parallel to the first flange, support pads on the first flanges located between the first and second flanges with a height less than the spacing between the first and second flanges, mounting means on two opposite sides of the base ring including lugs extending inwardly to engage under the distal edges of battens on opposite sides of a pallet thereby to mount the base ring on a pallet, a first pair of rectangular side panels each having a top, two sides and a bottom with an out-turned lug means of thickness allowing entry between the support pads and the second flanges on two opposed sides of the base ring, a second pair of rectangular side panels each having a top, two sides and a bottom with an out-turned lug means of thickness allowing entry between the support pads and the second flanges of the other sides of the base ring, the width of the panels of the second panel pair between the sides thereof is less than the width of the panels of the first panel pair and the panels of the second panel pair are disposed between the first panel pair and prevent bodily movement of the panels of the first panel pair to disengage the lugs means thereof from the engaged base ring flanges, and latching means to connect adjacent sides of the first and second panel pairs.

Figure 5:
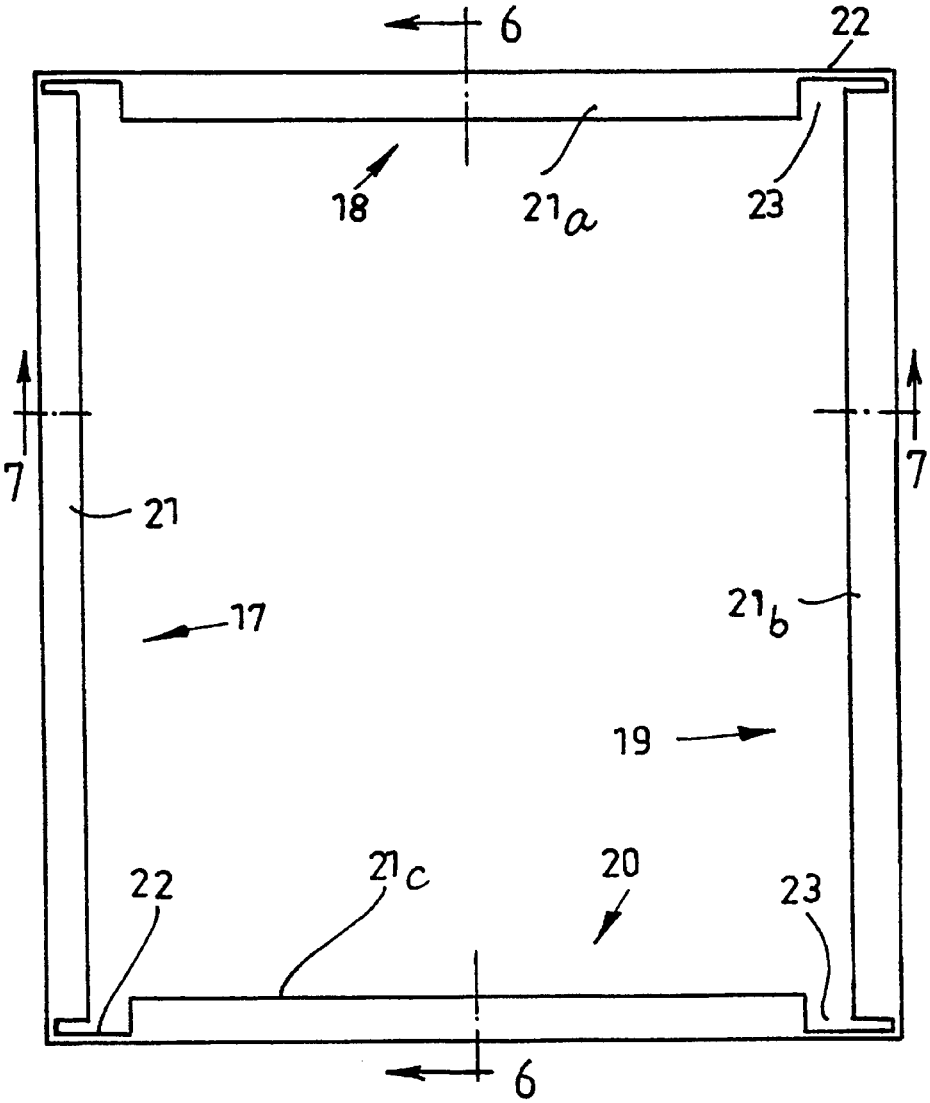
Figure 6:
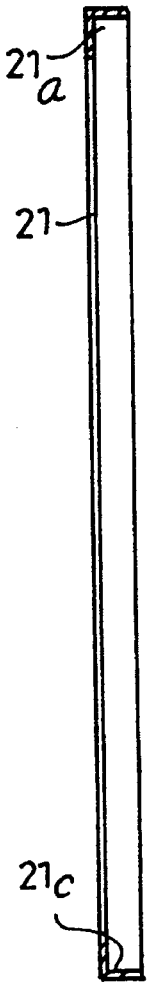
Figure 7:
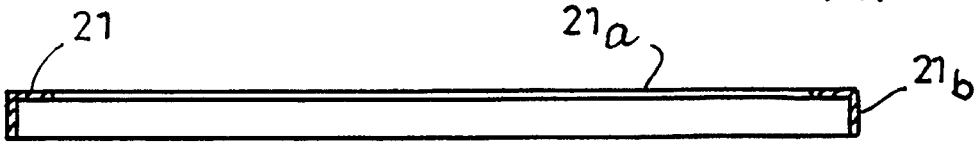

Presently preferred forms of the invention will now be described with reference to the accompanying drawings in which:

FIG. 1 is an exploded perspective view of the essential parts of the container kit of the invention in relationship to a pallet, specifically the base ring and one each of two types of container panel sides, FIG. 2 is a plan view of one part of a base ring of the kit, FIG. 3 is an sectional edge view of the part shown in FIG. 2 on the section line 3—3 of FIG. 2, FIG. 4 is an sectional edge view of the part shown in FIG. 2 on the section line 4—4 of FIG. 2, FIG. 5 is a plan view of a second part of a base ring of the kit, FIG. 6 is an sectional edge view of the part shown in FIG. 5 on the section line 6—6 of FIG. 5, FIG. 7 is an sectional edge view of the part shown in FIG. 5 on the section line 7—7 of FIG. 5, FIG. 8 is an enlarged fragmentary sectional view of the manner of mounting the base ring on a pallet, and FIG. 9 is an enlarged fragmentary sectional view of the manner of mounting an alternate form of base ring on a pallet.

The container of this invention comprises a base ring member 1 and four side members, herein after called panels, 2,3,4,5. A panel (not shown) to act as a lid where liquid transport is to be undertaken or where security of the container is required may be provided.

FIGS. 2 to 4 show the inner base component 6 of the two part base ring member 1. The component 6 is a rectangular frame having four sides 7,8,9,10. The sides are made of right angle steel joined at the corners with vertical flanges 11 and upper horizontal flanges 12. Fixed to the upper faces of the flanges 12 there are strategically located pads 13 to provide a clearance for a floor sheet to be described and it is to be noted that the pads 13 terminate short of the inner edges of the sides 7 to 10 to provide lands 14 to support the floor sheet.

On the side 10 there are two inwardly under-hook members 15 conveniently made of angle iron. The top edges of the members 15 stop short of the face of the flanges 12.

FIGS. 5 to 7 show the outer base component 16 comprised of four sides 17,18,19,20 comprised of right angle steel joined at the corners with an upper horizontal flange 21 and a vertical flange 22. The upper flanges 21 are cut away at 23 to form notches for a purpose to be disclosed later.

The inner and outer base components 6–16 are fixed together, as by welding, in a relationship to provide the base ring configuration shown in FIG. 1 and in the fragmentary sectional view FIG. 8. It will be seen that the underface of the horizontal flange 21 of the component 16 is spaced above the top face of the pad 13 and that the bottom edges of the vertical flanges 22 sit upon the top edges of the members 15. Further, it will be seen that the hook limb of the member 15 is adapted to engage under a long edge of a pallet batten 24 which lies below the flange 8. Opposed to the fixed members 15 and removably fastened by screws 42 to the base ring side 8 of the member 6 there are complementary demountable hooks 15*a*. The form and mounting of the base ring 1 to a pallet 43 is thus clear.

The side panel pairs 2,4 and 3,5 are adapted to be engaged with the base ring 1. The essential features of the panel sides can be seen from FIG. 1 and in the case of the panels 2 and 4 those features are top and bottom rails 27,28 joined by uprights 29,30. There are three horizontal reinforcing rails 31 end connected to the uprights 29,30. The members 27 to 31 are made of right angle steel with inner flanges forming a planar inner face and with horizontal out-turned flanges. Holes 32 are provided in the inner flanges of the uprights 29,30 and inturned portions 33 of hooking elements are provided at regular intervals along the inner faces of the uprights 29,30. It is to be noted that one of the portions 33 is at an elevation above the holes 32, this is desirable but not absolutely essential. The spacing between the portions 33 and the inner flanges of the uprights 29,30 is such as to receive the thickness of a sheet of plywood or the like fixed to the inner flanges of at least the members 27 to 30 and the thickness of the inturned flanges of the uprights of the end panels 3,5 now to be described.

A typical end panel 34 is shown in FIG. 1. Its form is generally the same as the side panels 2,4 in that the material is right angle steel and there are top and bottom rails 35 and 36, uprights 37 and 38 and reinforcing rails 39. Hand grips 40 are mounted on two of the reinforcing rails 39. Slide bolt retainers 41 are associated with the uprights 37,38 and when the panels are mounted on the base ring the slide bolts 44 mounted in the holders 41 will be aligned with the holes 32.

Referring to FIGS. 1 and 8, in an assembly operation to form a container on a pallet, the base ring 1 would first be mounted by means of the under-hooks 15–15*a* to the pallet 43. A first side panel 2 is lowered vertically onto the base ring so the bottom ends of the uprights 29,30 enter the notches 23 and then the side panel is moved bodily outwardly to enter the horizontal flange of the bottom rail 28 of the side panel 2 between the pads 13 and the base ring flange 21*b* where the horizontal flange of the bottom rail 28 will rest on the pads 13. The second side panel 4 is likewise positioned between the pads 13 and the flange 21. The side panels can adopt a slightly upwardly outwardly divergent relationship because of the clearance required between the pads 13 and the flanges 21 and 21*b* to allow the horizontal flanges of the bottom side rails 28 to be positioned as described.

The end panels 3 and 5 are then mounted in a similar manner with the ends of the uprights 37 and 38 in the notches 23 and by outward bodily movement the horizontal flanges of the bottom rails 36 are disposed between the pads 13 and the flanges 21*a* and 21*c* of the base ring 1. As this is done the side panels 2 and 3 are moved back to vertical so that the edge flanges of the uprights 37,38 will enter under the portions 33 on the panels 2 and 4. Minimal clearance is provided to minimise the possibility of relative movement of the sides when the container is in use, thereby minimising the likelihood of bag pinch. It is to be understood that all of the panels 2,3,4,5 are internally clad with plywood or the like.

When the engagement just described has been achieved the slide bolts 44 will be operated to engage in the holes 32 to lock the side panels 2,4 to the ends panels 3,5. It will be understood that the end panels 3,5 when mounted between the side panels 2,4 prevent inward movement of the side panels 2,4 and so disengagement of the side panel lower rails from below the flanges 21 and 21*b* is not possible whilst the end panels 3,5 are in place. In a similar manner when the bolts 44 are engaged they form pivot points for the end panels but pivoting is not possible to disengage the bottom flanges of the end panels from the below the flanges 21*a*, 21*c* because of the engagement of the flanges of the ends panels with the portions 33 above the bolt holes 32.

FIG. 9 shows an alternative arrangement where the pads 13 are not provided and the horizontal flanges 12 are no wider than the edges of the flanges 21 of the base member 16. With such an arrangement the floor panel 45 rests directly on the battens 24 of the pallet 43 and not upon the portions 12 of the members 7,8,9,10. The horizontal flanges of the rails 28 and 36 are in this arrangement disposed directly between the members 7 (8,9,10) and 21 and are not supported on the pads 13.

A suitable lid would be provided, typically made of right angle steel with flanges to project downwardly to embrace the top rails 27,35 of the side and end panels. Any suitable lid retaining-locking means could be used.

In The foregoing is to be understood as being a description of presently preferred embodiments of the invention and the parts and their interaction can be varied without departing from the inventive concept herein disclosed and hereinafter claimed.

I claim:

1. A container kit comprising a rectangular base ring which includes a pair of flanges inwardly directed from each side of the base ring thereby forming a horizontally inwardly directed mounting channel with an upper flange and a lower flange, mounting means to mount said base ring to a pallet, a first pair of rectangular side panels each having a top, two sides and a bottom with an out-turned lug means of thickness allowing entry into the mounting channel, a second pair of rectangular side panels each having a top, two sides and a bottom with an out-turned lug means of thickness allowing entry into the mounting channel, the width of the panels of the second panel pair between the sides thereof is less than the width of the panels of the first panel pair so that when all panels are assembled on a base ring with the lugs of the panels engaged with said mounting channel the panels of the second panel pair lie between the panels of the first panel pair and prevent the lugs of the panels of the first panel pair from being disengaged from the mounting channel, and latching means to connect adjacent sides of the first panel pair and the second panel pair.

2. A container kit as claimed in claim 1 including pads on inner faces of the lower channel flanges and spaced from inner faces of the upper channel flange sufficiently to allow the lug means of the panels pairs to enter between said pads and the inner faces of the upper flanges of the base ring.

3. A container kit comprising a rectangular base ring which includes a first flange inwardly directed from each side of the base ring, a second flange inwardly directed from each side of the base ring narrower than the first flange and spaced from and parallel to the first flange, support pads on the first flange located between the first and second flanges with a height less than the spacing between the first and second flanges, mounting means on two opposite sides of the base ring including lugs extending inwardly to engage under the distal edges of battens on opposite sides of a pallet thereby to mount the base ring on a pallet, a first pair of rectangular side panels each having a top, two sides and a bottom with an out-turned lug means of thickness allowing entry between the support pads and the second flanges on two opposed sides of the base ring, a second pair of rectangular side panels each having a top, two sides and a bottom with an out-turned lug means of thickness allowing entry between the support pads and the second flange of the other sides of the base ring, the width of the panels of the second panel pair between the sides thereof is less than the width of the panels of the first panel pair so that when all panels are coupled by their lug means engaging under the base ring flanges, the panels of the second panel pair lie between the panels of the first panel pair and prevent the lugs on the panels of the first panel pair from being disengaged from the base ring flanges, and latching means to connect adjacent sides of the first panel pair and the second panel pair.

4. A container kit as claimed in claim 3 where said base ring mounting means includes lugs fixed to one of said base ring opposed sides and lugs demountably connected to the other of said base ring opposite sides.

5. A container kit as claimed in claim 3 where the panels of the first and second panel pairs comprise a frame made of angle metal with corresponding first legs in a common plane and covered with sheet material which is fixed thereto and the other legs extend away from the sheet material, the said other legs of the angle metal at the bottom of the panels providing the lug means.

6. A container kit as claimed in claim 5 where said latching means comprises hook means and manually manipulatable bolt means, said hook means includes portions spaced along the sides of the panels of the first panel pair which overlie said sheet material and are spaced therefrom to allow the other legs of the angle metal forming the sides of the panels of the second panel pair to enter between said portions and said sheet material, and said bolt means includes sliding bolt members mounted on the panels of said second panel pair and sliding bolt accommodating holes through the first legs of the angle metal forming the sides of the panels of the first panel pair and the sheet material fixed thereto.

* * * * *